US008015850B2

(12) United States Patent
Tsuritani et al.

(10) Patent No.: US 8,015,850 B2
(45) Date of Patent: Sep. 13, 2011

(54) SPRING MANUFACTURING MACHINE

(75) Inventors: Katsuhide Tsuritani, Osaka (JP); Kyoji Yoshida, Osaka (JP)

(73) Assignee: Shinko Machinery Co., Ltd., Osaka-shi (JP)

( * ) Notice: Subject to any disclaimer, the term of this patent is extended or adjusted under 35 U.S.C. 154(b) by 936 days.

(21) Appl. No.: 12/000,983

(22) Filed: Dec. 19, 2007

(65) Prior Publication Data

US 2008/0264132 A1 Oct. 30, 2008

(30) Foreign Application Priority Data

Dec. 20, 2006 (JP) ..... 2006-343479

(51) Int. Cl.
*B21F 3/04* (2006.01)

(52) U.S. Cl. ..... 72/145

(58) Field of Classification Search ..... 72/135, 72/137, 138, 140, 145, 429, 441, 442, 446, 72/447, 450, 454
See application file for complete search history.

(56) References Cited

U.S. PATENT DOCUMENTS 5,657,657 A 8/1997 Welsh et al.
5,706,687 A 1/1998 Welsh et al.
6,000,265 A 12/1999 Itaya
6,006,572 A * 12/1999 Tsuritani ..... 72/135

FOREIGN PATENT DOCUMENTS

JP 2001-293533 A 10/2001
JP 2005-118798 A 5/2005

* cited by examiner

*Primary Examiner* — Debra Sullivan
(74) *Attorney, Agent, or Firm* — Birch, Stewart, Kolasch & Birch, LLP

(57) ABSTRACT

A swing bar is connected to a slide by attaching a first pivot to one end of the swing bar, and a bending die is mounted to the other end. A connecting piece is provided on the upper surface of the swing bar, and a second pivot capable of freely turning is inserted into a through-hole formed in the connecting piece, and then fitted into a guide groove formed parallel to the wire feeding direction in a guide member mounted to a second bending unit. Motors are connected to the slide and the second bending unit, respectively.

5 Claims, 10 Drawing Sheets

SPRING MANUFACTURING MACHINE

CROSS-REFERENCE TO RELATED APPLICATION

This non-provisional application claims priority under 35 U.S.C. §119(a) on Patent Application No. 2006-343479 filed in Japan on Dec. 20, 2006, the entire contents of which are hereby incorporated by reference.

BACKGROUND

1. Technical Field

The present invention relates to a spring manufacturing machine capable of manufacturing variety types of springs.

2. Description of Related Art

When manufacturing a coil spring using a spring manufacturing machine, a wire fed from a wire passage is bent and deformed by bringing it into contact with a bending die placed in the vicinity of the outlet of the wire passage. When manufacturing a coil spring with a gradually increasing outside diameter, the bending die which is in contact with the wire is moved in the wire feeding direction. Although the wire is in contact with the bending die at the center when the bending deformation of the wire is started, it comes into contact with the bending die at a position away from the center as the outside diameter increases. In order to bend and deform the wire, it is necessary to keep the wire in contact with the bending die, and therefore the bending die is caused to swing toward the center of the outside diameter as the outside diameter increases.

A conventional spring manufacturing machine comprises a first bending die mounting slide including a slide body disposed along the wire feeding direction and a swing member connected to the slide body; a drive source, connected to the first bending die mounting slide, for driving the first bending die mounting slide; second and third bending die mounting slides provided on the upper and lower sides, respectively, and inclined at an acute angle with respect to the feeding direction to manufacture right-hand and left-hand springs; a block body disposed on a front wall of a machine body and provided with a cam groove inclined at an acute angle with respect to the feeding direction; and a slider provided on the swing member to slide along the cam groove.

In this spring manufacturing machine, the bending die is mounted to an end of the swing member. When the slider is driven by the drive source and slides along the cam groove, the bending die mounted to the swing member moves in the feeding direction and also swings with the movement in the feeding direction and the swing of the swing member, so that it is possible to manufacture a coil spring with a gradually increasing outside diameter. When manufacturing a right-hand spring, the wire is brought into contact with the bending die mounted to the swing member and a bending die mounted to the second bending die mounting slide, and supported. When manufacturing a left-hand spring, the wire is brought into contact with the bending die mounted to the swing member and a bending die mounted to the third bending die mounting slide, and supported. Thus, since it is not necessary to support the wire in contact with a core provided on the front wall of the machine body, it is possible to prevent scratches from being made on the coil spring by the contact between the wire and the core (Japanese Patent Application Laid-Open No. 2005-118798).

In addition to the spring manufacturing machine disclosed in Japanese Patent Application Laid-Open No. 2005-118798, there is conventionally proposed a spring manufacturing machine comprising a bending die mounting slide with a slide disposed along the wire feeding direction and a swing piece mounted to the slide; and a drive source, connected to the swing piece, for swinging the swing piece.

In this spring manufacturing machine, the bending die is mounted to an end of the swing piece. By swinging the spring piece to a position where the bending die mounted to the end of the swing piece does not come into contact with the fed wire, it is possible to manufacture a spring requiring the formation of a straight portion, for example, a torsion spring having straight portions at both ends (see, Japanese Patent Application Laid-Open No. 2001-293533).

SUMMARY

In the spring manufacturing machine disclosed in Japanese Patent Application Laid-Open No. 2005-118798, the bending die moves and also swings with the movement in the feeding direction and swing of the swing member, and it is possible to manufacture a coil spring with a gradually increasing outside diameter. However, since the range of swing of the bending dies mounted to the swing member and the second bending die mounting slide is limited to a range in which the wire comes into contact with the bending die by the cam groove, it is impossible to swing the swing member to a position where the wire does not come into contact with the bending die, and thus it is impossible to manufacture a spring which requires the formation of a straight portion, for example, a torsion spring. Moreover, since the range of swing of the bending die is narrowed by the cam groove, it is difficult to manufacture a large-diameter coil spring. Further, the angle of inclination of the cam groove is fixed, the ratio of the swing angle to the advance and retreat distance of the swing member when manufacturing a coil spring with a gradually increasing outside diameter is fixed, and the outside diameter varying ratio to the axial distance of a coil spring to be manufactured is fixed. It is therefore difficult to adjust the swing angle and the advance and retreat distance of the swing member individually and change the outside diameter varying ratio according to the specifications of the coil spring to be manufactured.

With the spring manufacturing machine according to Japanese Patent Application Laid-Open No. 2001-293533, it is possible to form a spring requiring the formation of a straight portion by swinging the swing piece to a position where the wire does not come into contact with the bending die. However, since it is necessary to provide the swing piece with a drive source for swinging the swing piece, there is a problem that the manufacturing cost of the spring manufacturing machine increases.

In order to manufacture a spring which is to be manufactured using one bending die, such as a torsion spring, and a spring which is to be manufactured using a plurality of bending dies, such as a spring without scratches caused by the core, by using a single spring manufacturing machine, it is necessary to construct the spring manufacturing machine so that the number of bending dies to be used is changed to one, or more than one, according to a need. However, since the spring manufacturing machine disclosed in Japanese Patent Application Laid-Open No. 2001-293533 has only one bending die mounting slide, it is impossible to change the number of bending dies for use to more than one.

With the aim of solving the above problems, and it is an object to provide a spring manufacturing machine comprising a connecting member for connecting a swing bar of a first bending unit to one of second and third bending units, and capable of moving the swing bar to a position where a wire does not come into contact with a bending die mounted to the swing bar by a driving force of a drive source for driving the one bending unit, and thereby capable of manufacturing a spring which requires the formation of a straight portion, for example, a torsion spring, by swinging the swing bar without providing the swing bar with a drive source, and reducing the manufacturing cost.

It is another object to provide a spring manufacturing machine capable of manufacturing a large-diameter coil spring by attaching a first pivot to the connection section between the first bending unit and the swing bar, attaching a second pivot to the connection section between the swing bar and the second or third bending unit, converting the advance and retreat motion of one of the second and third bending units into swing motion of the swing bar with the first pivot as a fulcrum by the rotation of the first and second pivots, and causing the swing bar to make a big swing.

It is still another object to provide a spring manufacturing machine capable of reducing the manufacturing cost by providing an arm member for connecting the first bending unit to the other of the second and third bending units so as to transmit the driving force of the drive source for driving the other bending unit to the first bending unit, and causing the first bending unit to advance and retreat along the wire feeding direction without providing the first bending unit with a drive source.

It is yet another object to provide a spring manufacturing machine capable of manufacturing a coil spring by using a force in the feeding direction for the advance and retreat of the swing bar, making the swing and advance/retreat of the swing bar independent of each other, adjusting the swing angle and the advance/retreat distance of the swing bar individually and changing the outside diameter varying ratio, according to the specifications of the coil spring to be manufactured, by providing the second or third bending unit with a guide member having a guide groove for guiding the advance and retreat of the swing bar in the wire feeding direction and providing the first bending unit with a movable member that moves along the guide groove.

It is a further object to provide a spring manufacturing machine capable of manufacturing both of a spring which is to be manufactured using one bending die and a spring which is to be manufactured using a plurality of bending dies by, for example, providing the guide member with a recessed section and providing the second or third bending unit with a protruding section capable of being fitted detachably into the recessed section, fitting the guide member removably into the second or third bending unit to allow replacement of the guide member with a bending die, and changing the number of bending dies for use to one, or more than one, according to a need.

A spring manufacturing machine according to a first aspect is characterized by a spring manufacturing machine comprising: a wire passage through which a wire fed by a wire feeding roller passes; first, second and third bending units provided at an outlet of the wire passage so that they are capable of freely advancing toward and retreating from a wire processing space where the wire fed from the wire passage is processed into a coil spring; and two drive sources for driving said second and third bending units, respectively, wherein an advance/retreat direction of said first bending unit is placed along a wire feeding direction, said second and third bending units are placed on both sides of an advance and retreat area of said first bending unit, said first bending unit includes a swing bar which has one end connected to a center section of said first bending unit in the advance/retreat direction and other end to which a bending die is mounted, and swings on the one end as a center of swing, and said swing bar is connectable to one of said second or third bending unit through a connecting member and caused to swing by a driving force of the driving source for driving the one bending unit.

In the first aspect, by providing the connecting member for connecting the swing bar of the first bending unit to one of the second and third bending units, a driving force of the drive source for driving the second or third bending unit is transmitted to the swing bar through the connecting member, and the swing bar is caused to swing without providing the swing bar with a drive source. The bending die mounted to the other end of the swing bar swings to a position where the wire does not come into contact with the bending die, so that a straight portion is formed. Next, if a right-hand spring is to be formed, the bending die swings toward the second bending unit and comes into contact with the wire to form the right-hand spring, whereas if a left-hand spring is to be formed, the bending die swings toward the third bending unit and comes into contact with the wire to form the left-hand spring. Then, the bending die swings to a position where it does not come into contact with the wire to form a straight portion, and thus a torsion spring is manufactured.

A spring manufacturing machine according to a second aspect is characterized in that said swing bar is connected to said first bending unit with a first pivot, said connecting member has a second pivot, and said swing bar is connected to said second or third bending unit with said second pivot.

In the second aspect, the first pivot is attached to the connection section between the swing bar and the first bending unit, and the second pivot is attached to the connection section between the swing bar and the second or third bending unit. Hence, with the sequential rotations of the first and second pivots, the advance and retreat motion of the second or third bending unit is converted into swing motion of the swing bar with the first pivot as a fulcrum, and the swing bar makes a big swing.

A spring manufacturing machine according to a third aspect is characterized in that said first bending unit comprises a slide placed along the feeding direction, and said slide is connected to the other of said second and third bending units with an arm member and caused to advance and retreat by a driving force of the drive source for driving said other bending unit.

In the third aspect, by providing an arm member for connecting the first bending unit to the other of the second and third bending units, a driving force of a drive source for driving the other bending unit is transmitted to the first bending unit through the arm member, and the first bending unit is caused to advance and retreat in the wire feeding direction without providing the first bending unit with a drive source.

A spring manufacturing machine according to a fourth aspect is characterized in that said connecting member comprises a guide member which is provided on said second or third bending unit and has a guide groove for guiding the advance and retreat of said swing bar along the feeding direction, and a movable member which is provided on said first bending unit and moves along the guide groove.

In the fourth aspect, the second or third bending unit is provided with a guide member having a guide groove for guiding the advance and retreat of the swing bar in the wire feeding direction, and the first bending unit is provided with a movable member that moves along the guide groove. Therefore, when a force in the feeding direction is applied to the swing bar, the force in the feeding direction is used for the advance and retreat of the swing bar, thereby making the swing and the advance/retreat of the swing bar independent of each other.

A spring manufacturing machine according to a fifth aspect is characterized in that said guide member includes either one of a recessed section and a protruding section, said second or third bending unit includes the other, and said recessed section and protruding section are capable of being detachably fitted together.

In the fifth aspect, for example, the guide member is provided with a recessed section and the second or third bending unit is provided with a protruding section capable of being fitted detachably into the recessed section. Hence, when manufacturing a spring which is to be manufactured using one bending die, the guide member is mounted to the second or third bending unit, and the spring is bent and deformed by the bending die mounted to the first bending unit. Whereas when manufacturing a spring which is to be manufactured using a plurality of bending dies, the guide member is removed, a bending die is mounted to the second or third bending unit, and the spring is bent and deformed by the bending die mounted to the first bending unit and the bending die mounted to the second or third bending unit.

The above and further objects and features will more fully be apparent from the following detailed description with accompanying drawings.

DETAILED DESCRIPTION

Embodiment 1

Figure 1:
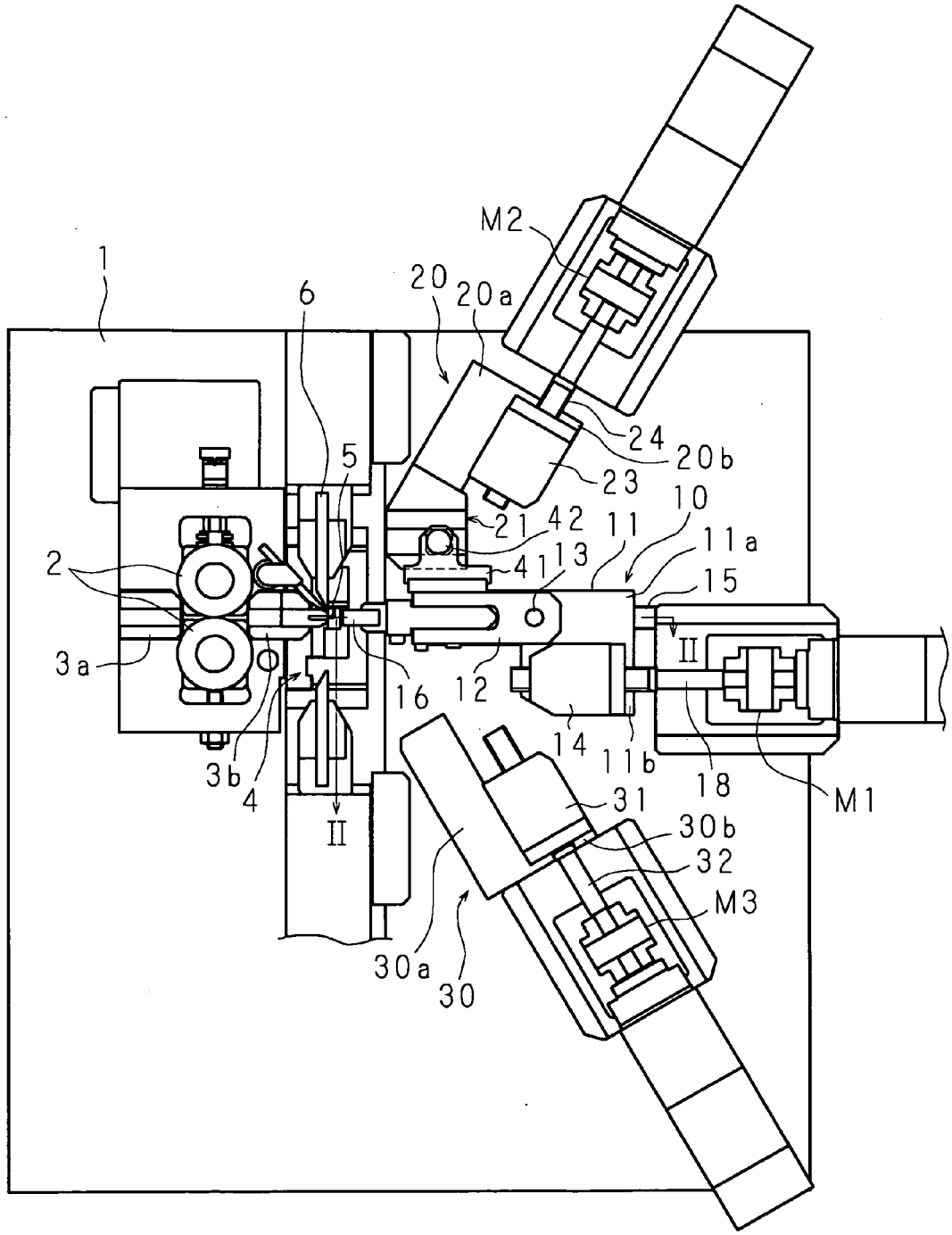
FIG. 1 is a front view showing an essential structure of a spring manufacturing machine according to Embodiment 1.
Figure 2:
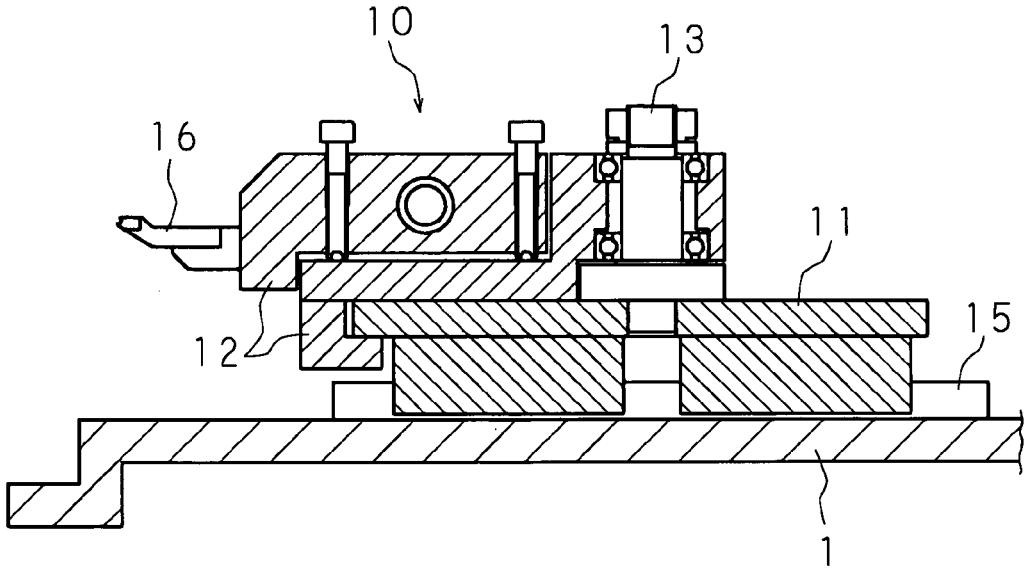
FIG. 2 is a cross sectional view along a line II-II in FIG. 1 showing an essential structure of a first bending unit of the spring manufacturing machine according to Embodiment 1.
Figure 3:
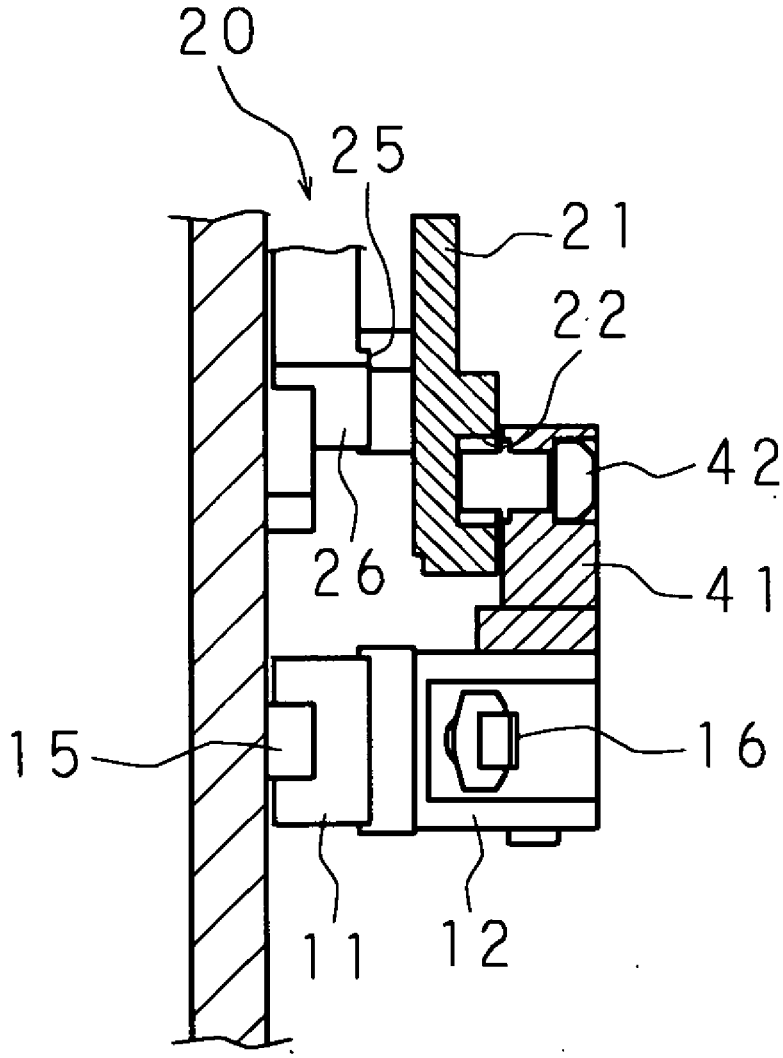
FIG. 3 is a cross sectional view showing an essential structure of a connecting member seen from the wire feeding roller side of the spring manufacturing machine according to Embodiment 1.

The following description will explain the present invention in detail, based on drawings illustrating a spring manufacturing machine according to Embodiment 1. FIG. 1 is a front view showing an essential structure of the spring manufacturing machine according to Embodiment 1, FIG. 2 is a cross sectional view along a line II-II in FIG. 1 showing an essential structure of a first bending unit, and FIG. 3 is a cross sectional view showing an essential structure of a connecting member seen from the wire feeding roller side. In the following explanation, the words "upper" and "lower" mean the upper side and the lower side, respectively, in the drawings.

In FIG. 1, 1 represents the front wall of the spring manufacturing machine, and the front wall 1 is provided with a pair of upper and lower wire feeding rollers 2 for horizontally feeding a wire. Provided behind the front wall 1 is a bobbin, not shown, around which the wire to be supplied to the wire feeding rollers 2 is wound. The wire wound around the bobbin is supplied through a pulley, not shown, to the wire feeding rollers 2. Wire guide 3*a* and wire guide 3*b* (wire passage), each having a groove in the center of a block for passing the wire, are provided on the upstream side and downstream side, respectively, of the wire feeding rollers 2. The wire is guided through the wire guide 3*a* to the wire feeding rollers 2, and the wire feeding rollers 2 guide the wire to the wire guide 3*b* with the counterclockwise rotation of the wire feeding roller 2 located on the upper side and the clockwise rotation of the wire feeding roller 2 located on the lower side.

A wire processing space 4 is formed in the vicinity of the outlet of the wire guide 3*b*. A first bending unit 10 is disposed along the wire feeding direction to face the outlet of the wire guide 3*b*. The wire guided to the outlet of the wire guide 3*b* is fed to the wire processing space 4 and comes into contact with a bending die 16 mounted to an end of the first bending unit 10. In order to certainly bend the wire, the bending die 16 has a substantially semi-circular groove for guiding the wire in a vertical direction, and the wire is bent and deformed in a desired direction according to the angle and position of the bending die 16 with which the wire comes into contact, thereby forming a desired spring.

A core 5 projecting frontward from the front wall 1 is placed at the outlet of the wire guide 3*b*, and a cutting tool slide having a cutter 6 at an end is provided on the upper side of the wire processing space 4. The cutting tool slide moves up and down to the wire processing space 4 along a guide rail, not shown, and the wire is sandwiched between the cutter 6 and the core 5. When the cutter 6 is lowered until it comes into contact with the core 5 in a sliding manner, the wire is cut and the spring is cut off.

The front wall 1 is provided with a guide rail 15 on a line extending in the wire feeding direction. The first bending unit 10 comprises a slide 11 that slides on the guide rail 15 and advances and retreats along the feeding direction. The slide 11 has a rectangular parallelepiped sliding section 11*a* that slides on the guide rail 15. The longitudinal direction of the sliding section 11*a* is the same direction as the sliding direction of the sliding section 11*a*. Connected to the lower side of the sliding section 11*a* is a block-shaped nut mounting section 11*b* to which a later-described nut section 14 is mounted.

One end of a rectangular parallelepiped swing bar 12 is connected to the center of the front surface of the sliding section 11*a* with a first pivot 13 perpendicular to the front surface so that it can freely pivot. The bending die 16 is mounted to the other end of the swing bar 12. The swing bar 12 swings clockwise or counterclockwise with the first pivot 13 as a fulcrum.

The nut section 14 is mounted to the front surface of the nut mounting section 11*b*, a male screw 18 is screwed into the nut section 14, and balls, not shown, are fitted in the grooves of the nut section 14 and the male screw 18 so that they can roll. The male screw 18 is connected to the rotation shaft of a motor M1 as a drive source. The motor M1 is capable of rotating in forward and reverse directions. The forward/reverse rotation of the motor M1 is converted into linear motion by the male screw 18, and the first bending unit 10 advances or retreats along the wire feeding direction.

A guide rail, not shown, running along a direction inclined upward (downward) at an acute angle with respect to the wire feeding direction is provided on the front wall 1. A second (third) bending unit 20 (30) is provided on the guide rail. The second (third) bending unit 20 (30) advances and retreats in a sliding manner along the guide rail. The second bending unit 20 and the third bending unit 30 are disposed at the same angle with respect to the wire feeding direction as the axis of symmetry.

The second (third) bending unit 20 (30) includes a rectangular parallelepiped sliding section 20*a* (30*a*) that slides on the guide rail. The longitudinal direction of the sliding section 20*a* (30*a*) is the same direction as the sliding direction of the sliding section 20*a* (30*a*). A nut mounting section 20*b* (30*b*) in the shape of a block is connected to the lower side of the sliding section 20*a* (30*a*), and a nut section 23 (31) is mounted to the nut mounting section 20*b* (30*b*). A male screw 24 (32) is screwed into the nut section 23 (31), and balls, not shown, are fitted in the grooves of the nut section 23 (31) and the male screw 24 (32) so that they can roll. The male screw 24 (32) is connected to the rotation shaft of a motor M2 (M3) as a drive source. The motor M2 (M3) is capable of rotating in forward and reverse directions. The forward/reverse rotation of the motor M2 (M3) is converted into linear motion by the male screw 24 (32), and the second (third) bending unit 20 (30) advances or retreats along a direction inclining at an acute angle from the wire feeding direction.

When the bending die 16 mounted to the other end of the swing bar 12 is positioned to face the outlet of the wire guide 3*b*, a square section of a connecting piece 41 (movable member), which connects the swing bar 12 and a later-described guide member 21, is arranged so that its edge in the longitudinal direction is fixed to a side surface of the swing bar 12 on the second bending unit 20 side. Connected to the square section is a projecting section projecting from the center in the longitudinal direction of the square section toward the second bending unit 20. In the projecting section, a through-hole piercing from the front side to the rear side thereof is formed. A second pivot 42 is inserted into the through-hole so that it can freely pivot, and fitted into a later-described guide groove 22.

A protruding section 26 protruding forward is provided at a section of the second bending unit 20 where the bending die is to be mounted. At the section where the bending die is to be mounted, a guide member 21 including a recessed section 25 on the rear side is mounted so that the recessed section 25 is detachably fitted on the protruding section 26. The second pivot 42 is fitted into the guide member 21 in a sliding manner, and the guide member 21 has a guide groove 22 on the front side for guiding the advance and retreat of the swing bar 12 along the wire feeding direction.

The guide groove 22 is formed so that it is substantially parallel with the wire feeding direction when the guide member 21 is mounted to the bending die mounting section. The second pivot 42 is fitted into the guide groove 22. The guide member 21 is mounted to the second bending unit 20, and the second bending unit 20 and the swing bar 12 are connected with the guide member 21, connecting piece 41 and second pivot 42. The connecting member is composed of the guide member 21, connecting piece 41 and second pivot 42. Note that the guide member 21 is not provided in the third bending unit 30, and the third bending unit 30 and the swing bar 12 are not connected together.

Figure 4A:
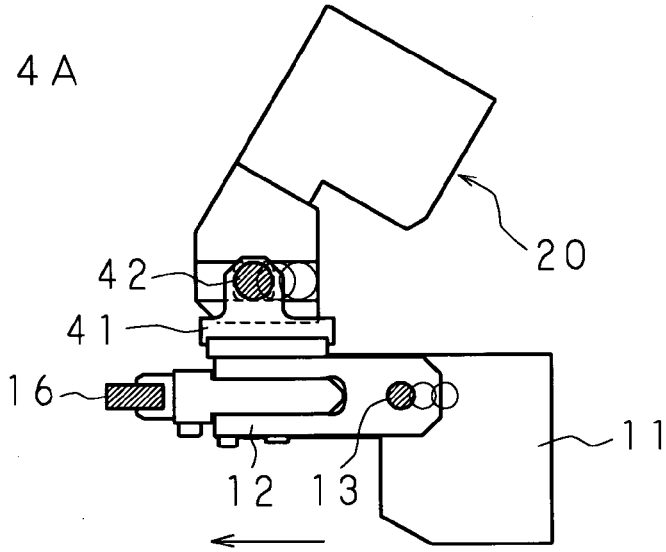
FIGS. 4A to 4C are explanatory views showing the advance/retreat and swing of the bending die of the spring manufacturing machine according to Embodiment 1.
Figure 4B:
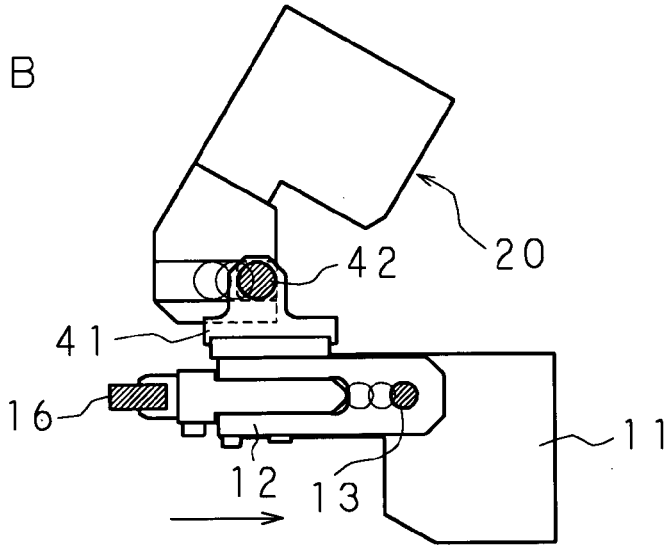
Figure 4C:
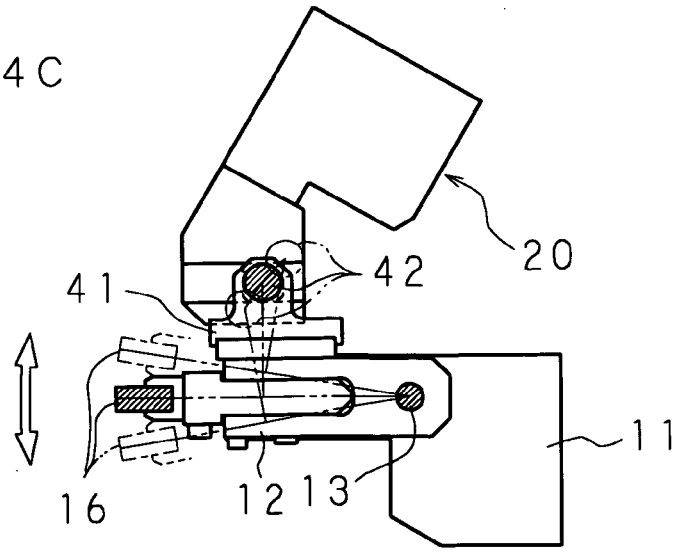

Next, the advance/retreat and swing of the bending die 16 will be explained. FIGS. 4A to 4C are explanatory views showing the advance/retreat and swing of the bending die 16. When the motor M1 rotates forward, the second pivot 42 slides toward the bending die 16 along the guide groove 22, and the connecting piece 41 moves along the guide groove 22. The first bending unit 10 advances toward the wire processing space 4, and the bending die 16 advances as shown by the arrow in FIG. 4A.

When the motor M1 rotates reversely, the second pivot 42 slides along the guide groove 22 toward the first pivot 13, and the connecting piece 41 moves along the guide groove 22. The first bending unit 10 retreats from the wire processing space 4, and the bending die 16 retreats as shown by the arrow in FIG. 4B.

When the motor M2 rotates forward, the second bending unit 20 advances toward the wire processing space 4, and the advance motion is converted into swing motion of the swing bar 12 with the first pivot 13 as a fulcrum by the rotations of the second pivot 42 and first pivot 13, and the bending die 16 swings counterclockwise as shown by the open arrow in FIG. 4C.

When the motor M2 rotates reversely, the second bending unit 20 retreats from the wire processing space 4, and the reverse motion is converted into swing motion of the swing bar 12 with the first pivot 13 as a fulcrum by the rotations of the second pivot 42 and first pivot 13, and the bending die 16 swings clockwise as shown by the open arrow in FIG. 4C.

Next, the operation of the spring manufacturing machine will be explained. FIGS. 5A to 5F are explanatory views showing the operation of the bending die 16 during the manufacture of a torsion spring.

A forward or reverse rotation signal is outputted to the motor M1 or M2 before the wire is fed, and the first and second bending units 10 and 20 are positioned so that the bending die 16 faces the outlet of the wire guide 3*b*.

Figure 5A:
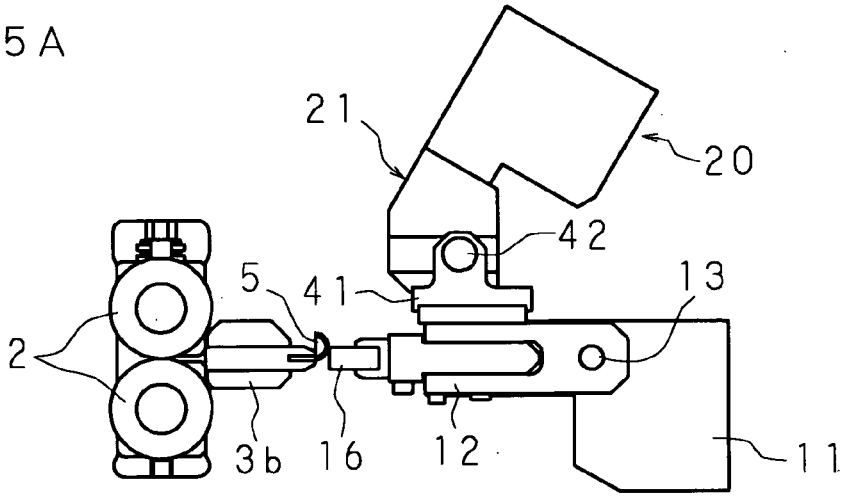
FIGS. 5A to 5F are explanatory views showing the operation of the bending die during the manufacture of a torsion spring by the spring manufacturing machine according to Embodiment 1.
Figure 5B:
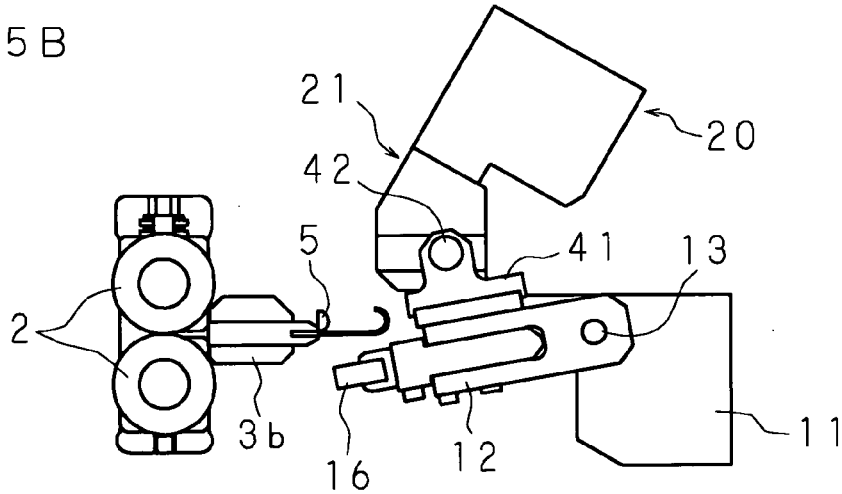
Figure 5C:
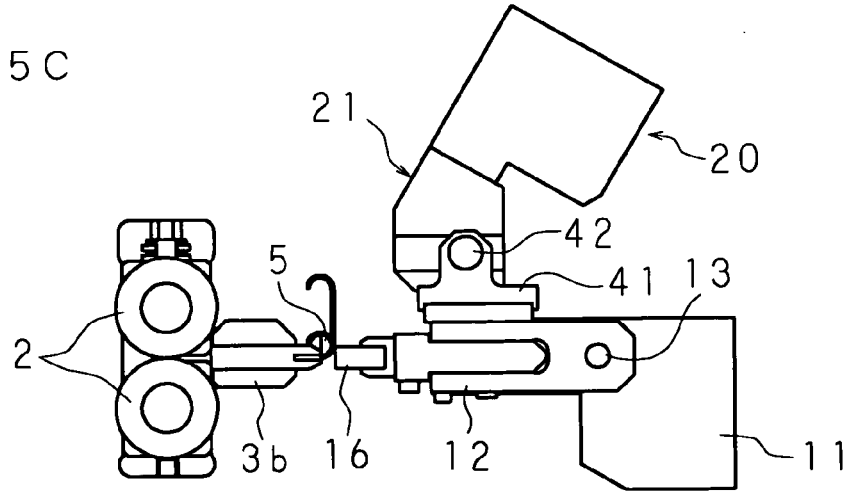
Figure 5D:
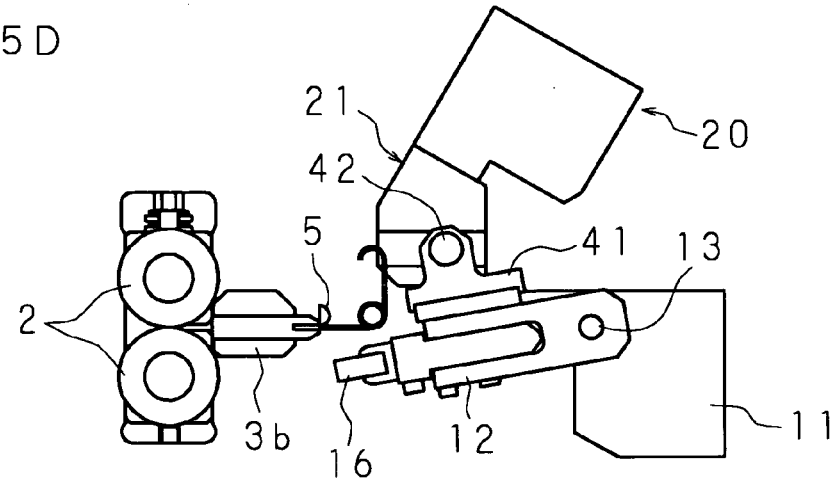
Figure 5E:
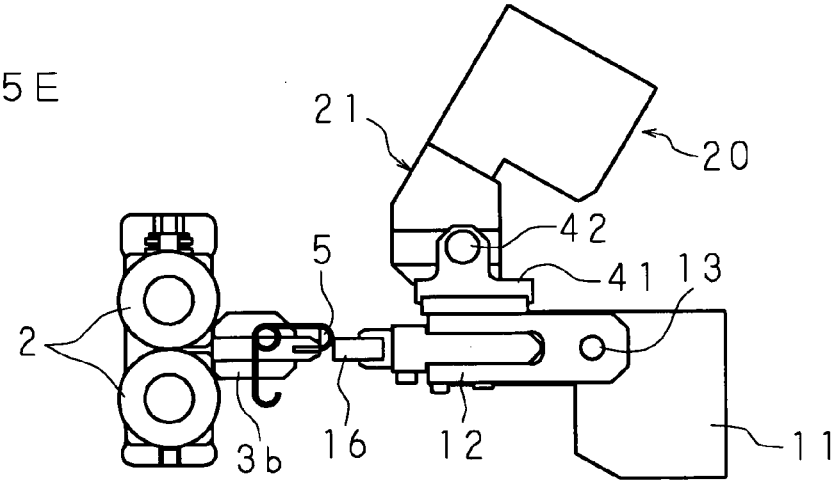
Figure 5F:
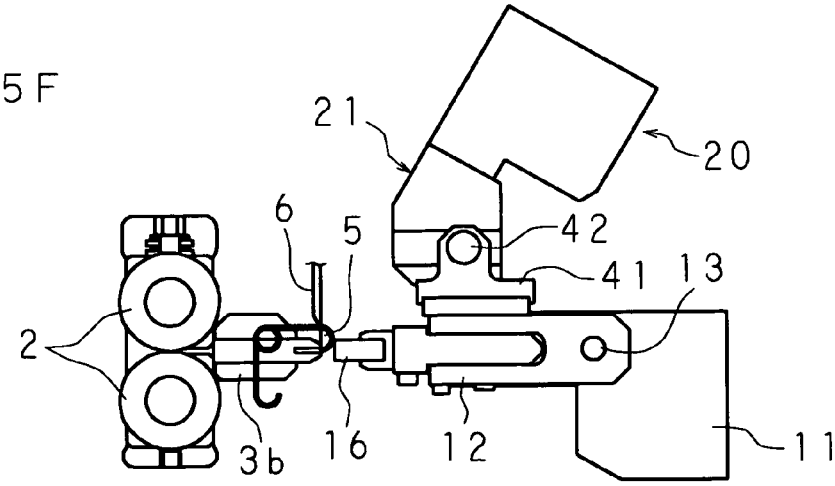

When the bending die 16 is positioned to face the outlet of the wire guide 3*b*, the wire is fed by the wire feeding rollers 2, comes into contact with the bending die 16 and is formed into a semi-circular shape (see FIG. 5A).

When the wire is formed into a semi-circular shape, a forward rotation signal is outputted to the motor M2. The motor M2 rotates at a predetermined rotation speed, the second bending unit 20 advances toward the wire processing space 4, and the swing bar 12 swings counterclockwise with the first pivot 13 as a furculum to a position where the wire does not come into contact with the bending die 16. Then, the wire advances straight above the bending die 16, so that a straight front leg section with a semi-circular end is formed (see FIG. 5B).

When the front leg section is formed, a reverse rotation signal is outputted to the motor M2. The motor M2 rotates at a predetermined rotation speed, the second bending unit 20 retreats from the wire processing space 4, and the swing bar 12 swings clockwise to a position where the bending die 16 faces the outlet of the wire guide 3*b*. Then, the bending die 16 comes into contact with the fed wire, the wire is bent and deformed, and a coil section turning clockwise is formed along the core 5 (see FIG. 5C).

When the coil section is formed, a forward rotation signal is outputted to the motor M2. The motor M2 rotates at a predetermined rotation speed, the second bending unit 20 advances toward the wire processing space 4, and the swing bar 12 swings counterclockwise with the first pivot 13 as a fulcrum to a position where the wire does not come into contact with the bending die 16. Then, the wire advances straight above the bending die 16, so that a straight rear leg section is formed (see FIG. 5D).

When the rear leg section is formed, a reverse rotation signal is outputted to the motor M2. The motor M2 rotates at a predetermined rotation speed, the second bending unit 20 retreats from the wire processing space 4, and the swing bar 12 swings clockwise to a position where the bending die 16 faces the outlet of the wire guide 3*b*. Then, the bending die 16 comes into contact with an end of the rear leg section, and the end is bent and deformed and moved to the upper side of the core 5 (see FIG. 5E). When the end is moved to the upper side of the core 5, the cutter 6 is lowered so that the end is sandwiched between the cutter 6 and the core 5, and then the end is cut and a torsion spring is cut off (see FIG. 5F).

By swinging the bending die 16 as described above, it is possible to manufacture a right-hand torsion spring. When manufacturing a left-hand torsion spring, the rotation of the motor M2 is set to reverse the swing direction of the bending die 16, or the guide member 21 is mounted to the third bending unit 30, the connecting piece 41 is attached to the lower surface of the swing bar 12, and the swing bar 12 and the third bending unit 30 are connected with the guide member 21, connecting piece 41 and second pivot 42. When manufacturing a spring using a plurality of bending dies, the guide member 21 is removed and a bending die is mounted to the second bending unit 20.

In the spring manufacturing machine according to Embodiment 1, by providing the guide member 21, connecting piece 41 and second pivot 42 for connecting the swing bar 12 of the first bending unit 10 and the second bending unit 20, the rotation of the motor M2 for driving the second tool mount sliding unit 20 is transmitted to the swing bar 12 through the guide member 21, connecting piece 41 and second pivot 42. The swing bar 12 swings without providing the swing bar 12 with a motor, and the bending die 16 mounted to the swing bar 12 swings to a position where the wire does not come into contact with it. Thus, it is possible to manufacture a spring that needs the formation of a straight section, for example, a torsion spring, and it is also possible to reduce the manufacturing cost.

Moreover, when manufacturing a spring which is to be manufactured using one bending die, such as a torsion spring, by providing the guide member 21 with the recessed section 25 and providing the second bending unit 20 with the protruding section 26 capable of being detachably fitted into the recessed section 25, the guide member 21 is mounted to the second bending unit 20. When manufacturing a spring which is to be manufactured using a plurality of bending dies, such as a spring without scratches caused by the core 5, the guide member 21 is removed from the second bending unit 20, and a bending die is mounted to the second bending unit 20. It is thus possible to manufacture both the spring which is to be manufactured using one bending die and the spring which is to be manufactured using a plurality of bending dies.

It is also possible to provide a plurality of pairs of wire feeding rollers 2. Moreover, it may be possible to use a hydraulic cylinder as a drive source. Further, it may be possible to provide a protruding section on the rear side of the guide member 21 and provide a recessed section in an end of the second bending unit 20.

Embodiment 2

Figure 6:
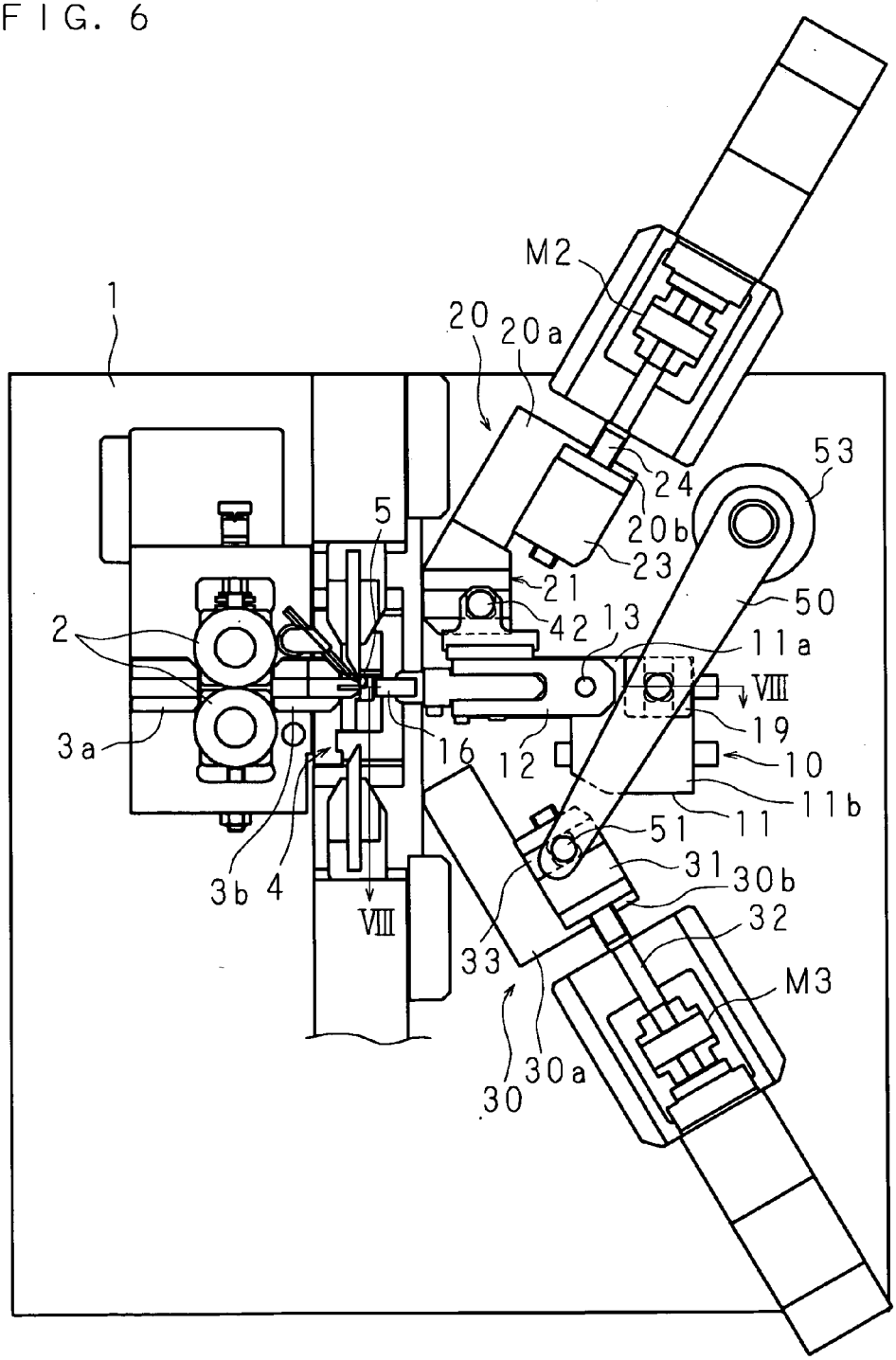
FIG. 6 is a front view showing an essential structure of a spring manufacturing machine according to Embodiment 2.
Figure 7:
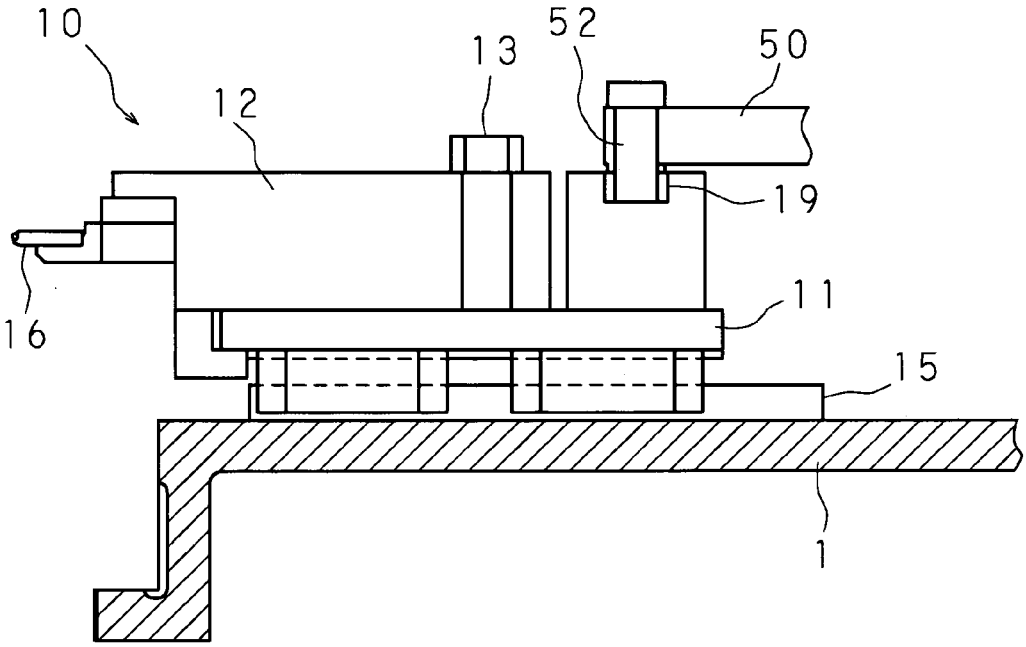
FIG. 7 is a cross sectional view along a line VIII-VIII in FIG. 6 showing an essential structure of a first bending unit of the spring manufacturing machine according to Embodiment 2.
Figure 8A:
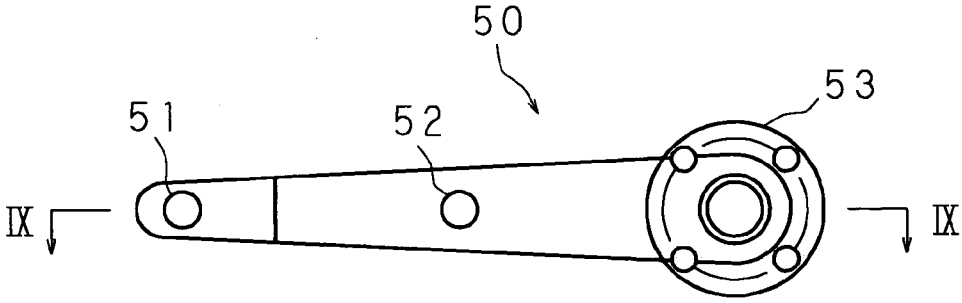
FIG. 8A is a plan view of an arm member of the spring manufacturing machine according to Embodiment 2.
Figure 8B:
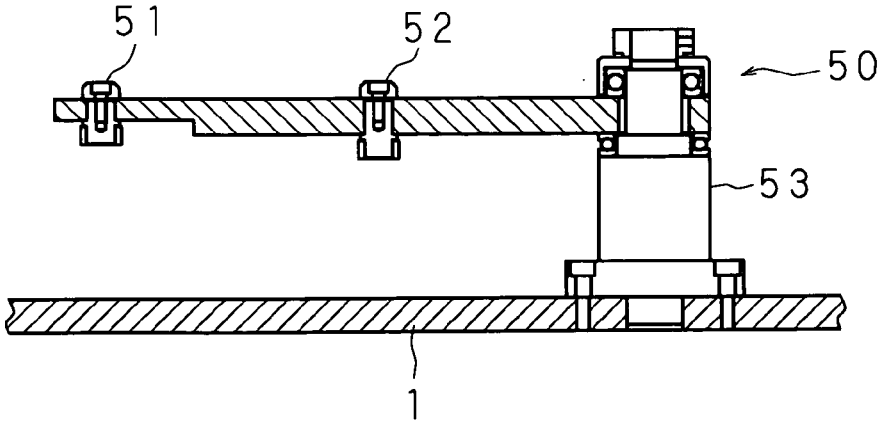
FIG. 8B is a cross sectional view of the arm member along a line IX-IX in FIG. 8A.

The following description will describe in detail the present invention, based on the drawings illustrating a spring manufacturing machine according to Embodiment 2. FIG. 6 is a front view showing an essential structure of the spring manufacturing machine, FIG. 7 is a cross sectional view along a line VIII-VIII in FIG. 6 showing an essential structure of a first bending unit 10, FIG. 8A is a plan view of an arm member 50, and FIG. 8B is a cross sectional view of the arm member 50 along a line IX-IX.

In the structures of the spring manufacturing machine according to Embodiment 2, structures similar to those in Embodiment 1 are designated with the same codes and the detailed explanation thereof is omitted.

A groove section 19 running at a right angle to the wire feeding direction is provided in the front surface of the sliding section 11*a* on a line extending to the wire feeding direction, and a groove section 33 running at a right angle to the axial direction of a male screw 32 is provided in a nut section 31 of the third bending unit 30.

In a region between the first bending unit 10 and the second bending unit 20, a support base 53 is provided on the front wall 1. One end of the arm member 50 is detachably supported on the support base 53. The arm member 50 is capable of swinging with the support base 53 as the center of rotation. The arm member 50 comprises a first protruding section 51 and a second protruding section 52 at the other end and the center thereof, respectively. The first protruding section 51 is fitted into the groove 33, while the second protruding section 52 is fitted into the groove 19.

When the third bending unit 30 is moved with the rotation of the motor M3, the first protruding section 51 slides along the groove section 33 and the second protruding section 52 slides along the groove section 19, so that the first bending unit 10 is moved together. Note that the first bending unit 10 is not provided with a motor.

Next, the following will explain the operation of the spring manufacturing machine when manufacturing a coil spring whose outside diameter gradually becomes larger. Before the wire is fed, the bending die 16 is positioned to face the outlet of the wire guide 3*b*.

When the wire is fed, the wire comes into contact with the bending die 16 and bent and deformed. Then, a reverse rotation signal is outputted to the motor M2 and M3, and the motor M2 and M3 rotate at a predetermined rotation speed. The second and third bending units 20 and 30 move in a direction away from the wire processing space 4, and the bending die 16 swings toward the second bending unit 20 with the first pivot 13 as a fulcrum and retreats from the wire processing space 4.

The retreat of the bending die 16 is carried out along the guide groove 22. The guide groove 22 is formed so that it is substantially parallel with the wire feeding direction when the guide member 21 is mounted to an end of the second bending unit 20, and the retreat of the bending die 16 is performed independently without interfering with the swing of the bending die 16. The wire is bent and deformed by contact with the bending die 16, and a coil spring with a gradually increasing outside diameter is formed.

Figure 9:
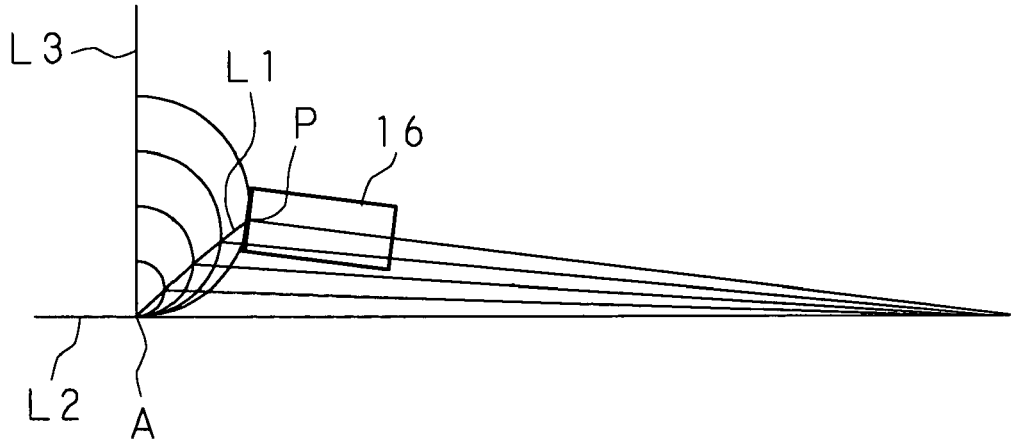
FIG. 9 is an explanatory view showing the moving direction of a bending die mounted to the first bending unit of the spring manufacturing machine according to Embodiment 2.

FIG. 9 is an explanatory view showing the moving direction of the bending die 16 mounted to the first bending unit 10. The bending die 16 has a substantially semi-circular groove for guiding the wire in a vertical direction, and the center point of the groove moves with the advance/retreat and swing of the swing bar 12. In FIG. 9, L1 shows the locus of the center point, point A is the outlet of the wire guide 3*b*, L2 is a horizontal line, and L3 is a vertical line. The shape of L1 is determined according to the shape of the coil section of the spring to be formed.

As described above, by moving the bending die 16 from the outlet of the wire guide 3*b*, it is possible to manufacture a coil spring having a right-hand coil section and a gradually increasing outside diameter. When manufacturing a coil spring having a left-hand coil section and a gradually increasing outside diameter, a forward rotation signal is outputted to the motor M2 and the second bending unit 20 is moved toward the wire processing space 4.

In the spring manufacturing machine according to Embodiment 2, by providing the arm member 50 for connecting the first bending unit 10 and the third bending unit 30, it is possible to transmit the driving force of the motor M3 which drives the third bending unit 30 to the first bending unit 10 through the arm member 50 and it is possible to cause the first bending unit 10 to advance/retreat along the wire feeding direction without providing the first bending unit 10 with a motor, thereby reducing the manufacturing cost of the spring manufacturing machine.

Moreover, by providing the second bending unit 20 with the guide member 21 having the guide groove 22 for guiding the advance and retreat of the swing bar 12 along the wire feeding direction and providing the first bending unit 10 with the connecting piece 41 that slides along the guide grove 22, the swing bar 12 advances/retreats in the wire feeding direction along the guide groove 22 when a force is applied in the feeding direction to the swing bar 12 by the motor M2, and thus the swing and the advance/retreat of the swing bar 12 are made independent of each other by using the force in the feeding direction for the advance and retreat of the swing bar 12. Hence, by adjusting the swing angle and the advance/retreat distance of the swing bar 12 individually and changing the outside diameter varying ratio according to the specifications of a coil spring to be manufactured, it is possible to manufacture the coil spring.

Further, by attaching the first pivot 13 to the connection section between the swing bar 12 and the first bending unit 10 and providing the second pivot 42 at the connection section between the guide member 21 and the connecting piece 41, the advance and retreat motion of the second bending unit 20 is converted into swing motion of the swing bar 12 with the first pivot 13 as a fulcrum by the sequential rotations of the first and second pivots 13 and 42. Then, by causing the swing bar 12 to make a big swing, it is possible to manufacture a large-diameter coil spring.

Note that it is also possible to build a structure in which the support base 53 is provided on the front wall 1 in the region between the first bending unit 10 and the third bending unit 30, a groove section orthogonal to the axial direction of the male screw 24 is formed in the nut section 23 of the second bending unit 20, the first bending unit 10 and the second bending unit 20 are connected with the arm member 50, and the swing bar 12 is connected to the third bending unit 30 with the guide member 21, connecting piece 41 and second pivot 42. Further, the coil spring to be manufactured is not limited to a coil spring whose outside diameter gradually increases, and it is also possible to manufacture a coil spring composed of a portion where the outside diameter of the spring gradually increases and a portion where the outside diameter of the spring gradually decreases.

As this description may be embodied in several forms without departing from the spirit of essential characteristics thereof, the present embodiments are therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A spring manufacturing machine comprising:

a wire passage through which a wire fed by a wire feeding roller passes;

first, second and third bending units provided at an outlet of the wire passage so that they are capable of freely advancing toward and retreating from a wire processing space where the wire fed from the wire passage is processed into a coil spring; and two drive sources for driving said second and third bending units, respectively, wherein an advance/retreat direction of said first bending unit is placed along a wire feeding direction, said second and third bending units are placed on both sides of an advance and retreat area of said first bending unit, said first bending unit includes a swing bar which has one end connected to a center section of said first bending unit in the advance/retreat direction and other end to which a bending die is mounted, and swings on the one end as a center of swing, and said swing bar is connectable to one of said second or third bending unit through a connecting member and caused to swing by a driving force of the driving source for driving the one bending unit.

2. The spring manufacturing machine according to claim 1, wherein said swing bar is connected to said first bending unit with a first pivot, said connecting member has a second pivot, and said swing bar is connected to said second or third bending unit with said second pivot.

3. The spring manufacturing machine according to claim 1, wherein said first bending unit comprises a slide placed along the feeding direction, and said slide is connected to the other of said second and third bending units with an arm member and caused to advance and retreat by a driving force of the drive source for driving said other bending unit.

4. The spring manufacturing machine according to claim 1, wherein said connecting member comprises a guide member which is provided on said second or third bending unit and has a guide groove for guiding the advance and retreat of said swing bar along the feeding direction, and a movable member which is provided on said first bending unit and moves along the guide groove.

5. The spring manufacturing machine according to claim 4, wherein said guide member includes either one of a recessed section and a protruding section, said second or third bending unit includes the other, and said recessed section and protruding section are capable of being detachably fitted together.

* * * * *